US009337010B2

(12) United States Patent
Cherepy et al.

(10) Patent No.: US 9,337,010 B2
(45) Date of Patent: May 10, 2016

(54) FLUORESCENT LIGHTING WITH ALUMINUM NITRIDE PHOSPHORS

(71) Applicants: Lawrence Livermore National Security, LLC., Livermore, CA (US); GE Electric Company, Schenectady, NY (US)

(72) Inventors: Nerine J. Cherepy, Piedmont, CA (US); Stephen A. Payne, Castro Valley, CA (US); Zachary M. Seeley, Livermore, CA (US); Alok M. Srivastava, Niskayuna, NY (US)

(73) Assignees: Lawrence Livermore National Security, LLC, Livermore, CA (US); General Electric Company, Schenectady, NY (US)

( * ) Notice: Subject to any disclaimer, the term of this patent is extended or adjusted under 35 U.S.C. 154(b) by 0 days.

(21) Appl. No.: 14/840,839

(22) Filed: Aug. 31, 2015

(65) Prior Publication Data

US 2016/0071718 A1 Mar. 10, 2016

Related U.S. Application Data

(60) Provisional application No. 62/046,768, filed on Sep. 5, 2014.

(51) Int. Cl.
*H01J 1/62* (2006.01)
*H01J 61/44* (2006.01)
(Continued)

(52) U.S. Cl.
CPC . *H01J 61/44* (2013.01); *H01J 9/22* (2013.01); *H01J 9/247* (2013.01); *H01J 61/20* (2013.01)

(58) Field of Classification Search
CPC ..... H01J 61/144; H01J 9/22; H01J 9/247; H01J 61/20; C09K 11/0883; C09K 11/7734; H01L 33/502
See application file for complete search history.

(56) References Cited

U.S. PATENT DOCUMENTS 4,874,984 A 10/1989 Sigai et al.
6,137,217 A * 10/2000 Pappalardo ..... C09K 11/666 313/467

(Continued)

OTHER PUBLICATIONS

Inoue et al., "Highly Efficient and Thermally Stable Blue-Emitting AlN:Eu2+ Phosphor for Ultraviolet White Light Emitting Diodes", J. of Phys. Chem. C, vol. 113, pp. 9392-9397 (2009).

(Continued)

*Primary Examiner* — Tracie Y Green
(74) *Attorney, Agent, or Firm* — Eddie E. Scott

(57) ABSTRACT

A fluorescent lamp includes a glass envelope; at least two electrodes connected to the glass envelope; mercury vapor and an inert gas within the glass envelope; and a phosphor within the glass envelope, wherein the phosphor blend includes aluminum nitride. The phosphor may be a wurtzite (hexagonal) crystalline structure $Al_{(1-x)}M_xN$ phosphor, where M may be drawn from beryllium, magnesium, calcium, strontium, barium, zinc, scandium, yttrium, lanthanum, cerium, praseodymium, europium, gadolinium, terbium, ytterbium, bismuth, manganese, silicon, germanium, tin, boron, or gallium is synthesized to include dopants to control its luminescence under ultraviolet excitation. The disclosed $Al_{(1-x)}M_xN$:Mn phosphor provides bright orange-red emission, comparable in efficiency and spectrum to that of the standard orange-red phosphor used in fluorescent lighting, $Y_2O_3$:Eu. Furthermore, it offers excellent lumen maintenance in a fluorescent lamp, and does not utilize "critical rare earths," minimizing sensitivity to fluctuating market prices for the rare earth elements.

26 Claims, 4 Drawing Sheets

(51) Int. Cl.

| | |
|---|---|
| ***H01J 61/20*** | (2006.01) |
| ***H01J 9/24*** | (2006.01) |
| ***H01J 9/22*** | (2006.01) |

(56) References Cited

U.S. PATENT DOCUMENTS

| | | | | |
|---|---|---|---|---|
| 6,613,248 | B2 | 9/2003 | Setlur et al. | |
| 6,844,671 | B2 | 1/2005 | Setlur et al. | |
| 6,867,536 | B2 | 3/2005 | Srivastava et al. | |
| 7,026,755 | B2 | 4/2006 | Setlur et al. | |
| 7,088,038 | B2 | 8/2006 | Srivastava et al. | |
| 7,935,325 | B2 * | 5/2011 | Han | C01B 21/072 117/11 |
| 7,990,040 | B2 | 8/2011 | Srivastava et al. | |
| 2010/0039020 | A1 * | 2/2010 | Hirosaki | C04B 35/581 313/483 |

OTHER PUBLICATIONS

Jüstel et al., "New Developments in the Field of Luminescent Materials for Lighting and Displays", Angew. Chem. Int. Ed., vol. 37, pp. 3084-3103 (1998).

Metselaar et al, "Surface Characterization of Chemically Treated Aluminium Nitride Powders", Journal of the European Ceramic Society, vol. 15, pp. 1079-1085 (1995).

Molisani et al., "Low-Temperature Synthesis of AIN Powder with Multicomponent Additive Systems by Carbothermal Reduction—Nitridation Method", Materials Research Bulletin, vol. 45, pp. 733-738 (2010).

Ramisetty et al., "Manufacturing of Aluminum Nitride Powder for Advanced Applications", American Ceramic Society Bulletin, vol. 93, No. 6, pp. 28-31 (2014).

Sato et al., "Characterization of AIN:Mn Thin Film Phosphors Prepared by Metalorganic Chemical Vapor Deposition", Journal of Crystal Growth, vol. 298, pp. 379-382 (2007).

Sato et al., "Low-Temperature Metalorganic Chemical Vapor Deposition of Luminescent Manganese-Doped Aluminum Nitride Films", Applied Physics Letters, vol. 87, pp. 021907-1 to 021907-3, (2005).

Wang et al., "A Novel and High Brightness AIN:Mn2+ Red Phosphor for Field Emission Displays", The Royal Society of Chemistry, Dalton Transactions, vol. 43, pp. 6120-6127 (2014).

Zhang et al., "Luminescence Properties of Red Long-Lasting Phosphorescence Phosphor AIN:Mn2+", ECS Journal of Solid State Science and Technology, vol. 2, pp. R117-R120 (2013).

* cited by examiner

FLUORESCENT LIGHTING WITH ALUMINUM NITRIDE PHOSPHORS

CROSS-REFERENCE TO RELATED APPLICATIONS

This application claims priority to and benefit under 35 U.S.C. §119(e) of U.S. Provisional Patent Application No. 62/046,768 filed Sep. 5, 2014 entitled "Aluminum Nitride Phosphors for Fluorescent Lighting," the content of which is hereby incorporated by reference in its entirety for all purposes.

STATEMENT AS TO RIGHTS TO APPLICATIONS MADE UNDER FEDERALLY SPONSORED RESEARCH AND DEVELOPMENT

The United States Government has rights in this application pursuant to Contract No. DE-AC52-07NA27344 between the United States Department of Energy and Lawrence Livermore National Security, LLC for the operation of Lawrence Livermore National Laboratory.

BACKGROUND

1. Field of Endeavor

The present application relates to fluorescent lighting and more particularly to aluminum nitride phosphors for fluorescent lighting.

2. State of Technology

This section provides background information related to the present disclosure which is not necessarily prior art.

U.S. Pat. No. 6,867,536 for a blue-green phosphor for fluorescent lighting applications issued Mar. 15, 2005 to Alok Srivastava, Holly Comanzo, and Venkatesan Manivannan of General Electric Company provides the state of technology information reproduced below.

"Fluorescent lamps typically have a transparent glass envelope enclosing a sealed discharge space containing an inert gas and mercury vapor. When subjected to a current provided by electrodes, the mercury ionizes to produce radiation having primary wavelengths of 185 nm and 254 nm. This ultraviolet radiation, in turn, excites phosphors on the inside surface of the envelope to produce visible light which is emitted through the glass.

Generally, a fluorescent lamp for illumination uses a phosphor which absorbs the 254 nm Hg-resonance wave and is activated so as to convert the ultraviolet luminescence of mercury vapor into visible light. In some conventional fluorescent lamps, a white-emitting calcium halophosphate phosphor, such as $Ca._{10}(PO_4)_6(F,Cl)_2$:Sb,Mn, has been used. More recently, in order to improve the color-rendering properties and emission output of fluorescent lamps, efficient illumination of a white color is provided using a three-band type fluorescent lamp which employs the proper mixture of red, green and blue-emitting phosphors whose emission spectrum occupies a relatively narrow band, has been put to practical use. For example, for the blue-emitting phosphor, europium-activated barium magnesium aluminate phosphor ($BaMg_2Al_{16}O_{27}$:$Eu^{2+}$), for the green-emitting phosphor, cerium and terbium-activated magnesium aluminate phosphor [(Ce,Tb)$MgAl_{11}O_{19}$], and for the red-emitting phosphor, europium-activated yttrium oxide phosphor ($Y_2O_3$:$Eu^{3+}$) may be used and are mixed in an adequate ratio. The combined spectral output of the phosphor blend produces a white light.

In such a three-band type phosphor lamp, the emitting colors of the respective phosphors are considerably different from one another. Therefore, if the emitting intensity of any of the three corresponding phosphors is decreased, color deviation occurs, degrading the color-rendering properties of the lamp.

The apparent color of a light source is described in terms of color temperature, which is the temperature of a black body that emits radiation of about the same chromaticity as the radiation considered. A light source having a color temperature of 3000 Kelvin has a larger red component than a light source having a color temperature of 4100 Kelvin. The color temperature of a lamp using a phosphor blend can be varied by changing the ratio of the phosphors.

Color quality is further described in terms of color rendering, and more particularly color rendering index (CRI or $R_a$), which is a measure of the degree to which the psycho-physical colors of objects illuminated by a light source conform to those of a reference illuminant for specified conditions. CRI is in effect a measure of how well the spectral distribution of a light source compares with that of an incandescent (black-body) source, which has a Planckian distribution between the infrared (over 700 nm) and the ultraviolet (under 400 nm). The discrete spectra which characterize phosphor blends will yield good color rendering of objects whose colors match the spectral peaks, but not as good of objects whose colors lie between the spectral peaks.

The color appearance of a lamp is described by its chromaticity coordinates which can be calculated from the spectral power distribution according to standard methods. See CIE, Method of measuring and specifying color rendering properties of light sources (2nd ed.), Publ. CIE No. 13.2 (TC-3,2), Bureau Central de la CIE, Paris, 1974. The CIE standard chromaticity diagram includes the color points of black body radiators at various temperatures. The locus of black body chromaticities on the x,y-diagram is known as the Planckian locus. Any emitting source represented by a point on this locus may be specified by a color temperature. A point near but not on this Planckian locus has a correlated color temperature (CCT) because lines can be drawn from such points to intersect the Planckian locus at this color temperature such that all points look to the average human eye as having nearly the same color. Luminous efficacy of a source of light is the quotient of the total luminous flux emitted by the total lamp power input as expressed in lumens per watt (LPW or lm/W).

Spectral blending studies have shown that the luminosity and CRI of white light sources are dependent upon the spectral distribution of color components. Blue or bluish-green phosphors are important components, the performance of which is important to maximize CRI. It is expected that such phosphors preserve structural integrity during extended lamp operation such that the phosphors remain chemically stable over a period of time while maintaining stable CIE color coordinates of the lamp. For class M and AAA high color rendering fluorescent lamps, a bluish-green phosphor is highly desired. Such phosphors can be used in conjunction with existing 3-band lamps to increase the lamp's CRI."

SUMMARY

Features and advantages of the disclosed apparatus, systems, and methods will become apparent from the following description. Applicant is providing this description, which includes drawings and examples of specific embodiments, to give a broad representation of the apparatus, systems, and methods. Various changes and modifications within the spirit and scope of the application will become apparent to those skilled in the art from this description and by practice of the apparatus, systems, and methods. The scope of the apparatus, systems, and methods is not intended to be limited to the particular forms disclosed and the application covers all modifications, equivalents, and alternatives falling within the spirit and scope of the apparatus, systems, and methods as defined by the claims.

Fluorescent lamp phosphors must meet a number of requirements, including: (1) strong absorption of the ultraviolet emission from mercury vapor (254 nm), (2) low absorption of the visible light emitted by the phosphors, (3) high quantum efficiency of conversion of the 254 nm light into visible light, (4) emission color stable, reproducible and meeting strict CIE coordinates to permit its use in a "tri-phosphor" blend by offering a spectrum that may be defined as "blue," "green," or "orange-red," (5) stability when exposed to high temperatures, (6) stability to water for storage and application onto the lamp envelope, (7) stability when exposed to high intensity ultraviolet light and mercury vapor. Requirements 1-4 provide the efficiency and quality of light needed, while 5 and 6 allow cost-effective processing, and 7 is needed for acceptable "lumen maintenance" or longevity of the phosphor under normal lamp operating conditions.

The inventors have developed a phosphor that does not utilize "critical rare earths." The inventor's phosphor includes aluminum nitride in the form of a powder which can be stored in water as a slurry, deposited on the inner surface of a lamp envelope and adhered to the envelope by heating in air. Aluminum nitride can form in several crystal structures, wurtzite, zincblende and rocksalt. The wurtzite form is most thermodynamically stable and only crystalline wurtzite (hexagonal phase) AlN and the variants based on the formula $Al_{(1-x)}M_xN$ are considered here (where M is a metal ion dopant). While undoped aluminum nitride emits blue light, it may additionally be doped with a variety of elements to promote visible luminescence, upon which the intrinsic defect-related blue emission is no longer observed, instead, emission from the dopant species dominates. In particular, doping with manganese results in strong orange-red emission from AlN. In one embodiment the inventors have developed a fluorescent lamp including a glass envelope; at least two electrodes connected to the glass envelope; mercury vapor and an inert gas within the glass envelope; and a phosphor blend on the inner surface of the glass envelope, wherein the phosphor blend includes aluminum nitride. Importantly, aluminum nitride has been found to exhibit excellent "lumen maintenance". To determine this feature of the AlN phosphor, the inventors tested the phosphor in a lamp under excitation conditions greater than normal and found no degradation in the phosphor's light output.

The inventors have synthesized manganese-doped AlN powder, and found it to offer high efficiency orange-red luminescence, when excited by the 254 nm mercury emission line. Its emission spectrum is very closely matched in CIE coordinates to that of the standard commercial orange-red phosphor, $Y_2O_3$:Eu. As such, AlN:Mn can function as a "drop-in" replacement for $Y_2O_3$:Eu. Fluorescent lamps may be manufactured that offer a range of CRI values and different qualities of white light, depending on the ratio of the blue, green and orange-red phosphors.

Many possible synthesis methods that may be used to form the AlN:Mn phosphor, among others, include:

(1) a solid-state reaction of AlN with a source of manganese in a high temperature nitrogen atmosphere, two examples of this are:

$$AlN(s)+xMnO \rightarrow AlN{:}xMn+(x/2)O_2(g) \quad (a)$$

$$AlN(s)+(x/3)Mn_3N_2 \rightarrow AlN{:}xMn \quad (b)$$

(2) carbothermal reaction, one example of this is:

$$Al_2O_3(s)+3C(s)+N_2(g)+xMn \rightarrow AlN{:}xMn+CO_2(g)$$

(3) direct nitridation of vapor or finely divided aluminum/manganese alloy, where the Mn content may range from 0.001% to 5%, the general reaction is:

$$2Al{:}Mn\ (s/l/g)+N_2(g) \rightarrow 2AlN{:}Mn(s)$$

Where "s" denotes solid, "1" is liquid, and "g" is gas or vapor.

Powder syntheses of AlN:Mn, as described above, typically yield particles with size between about 0.1 to 50 microns. Since fluorescent lighting functions best with 5-7 micron particles, additional steps such as ball milling may be required to reduce the average particle size.

The apparatus, systems, and methods are susceptible to modifications and alternative forms. Specific embodiments are shown by way of example. It is to be understood that the apparatus, systems, and methods are not limited to the particular forms disclosed. The apparatus, systems, and methods cover all modifications, equivalents, and alternatives falling within the spirit and scope of the application as defined by the claims.

BRIEF DESCRIPTION OF THE DRAWINGS

The accompanying drawings, which are incorporated into and constitute a part of the specification, illustrate specific embodiments of the apparatus, systems, and methods and, together with the general description given above, and the detailed description of the specific embodiments, serve to explain the principles of the apparatus, systems, and methods.

DETAILED DESCRIPTION OF SPECIFIC EMBODIMENTS

Figure 1:
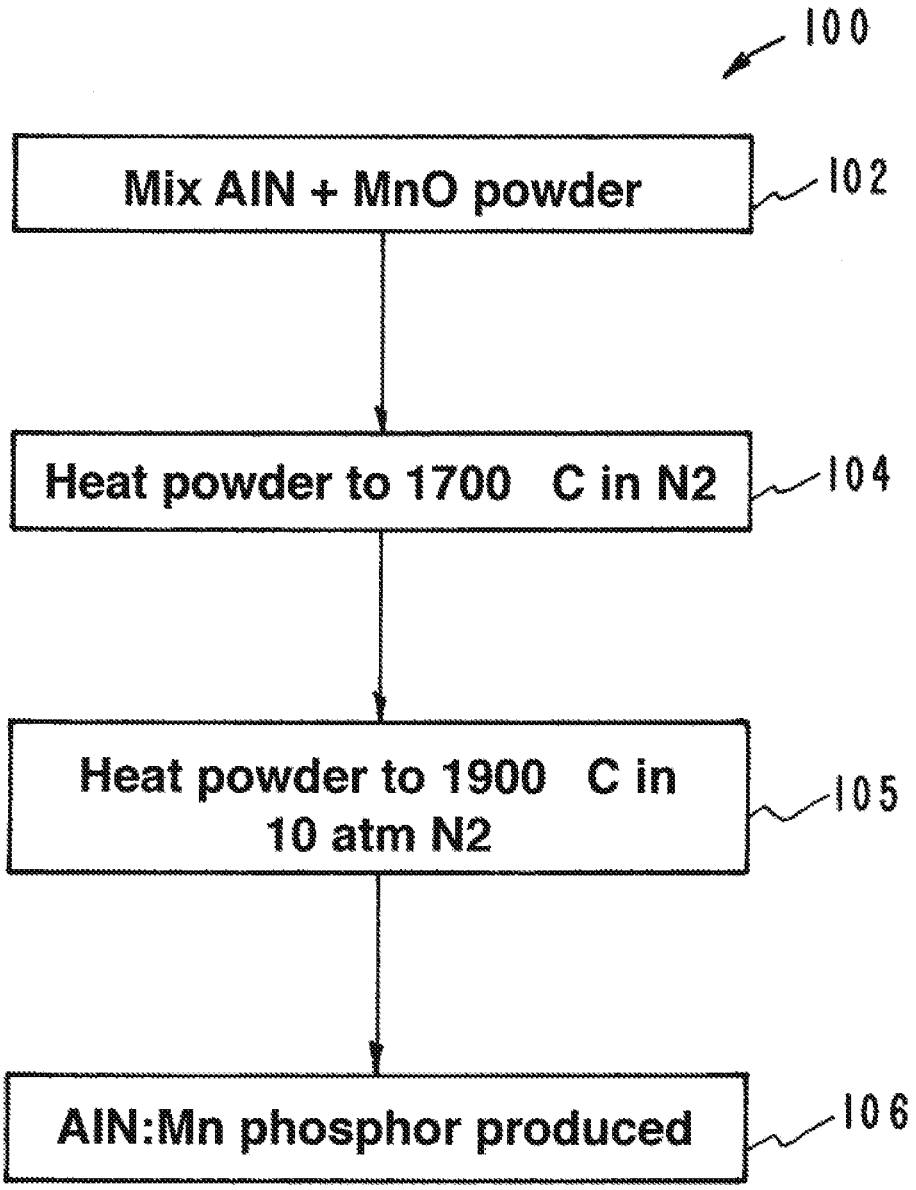
FIG. 1 is a flow chart illustrating a method of making one embodiment of a phosphor of the subject application.

Referring to the drawings, to the following detailed description, and to incorporated materials, detailed information about the apparatus, systems, and methods is provided including the description of specific embodiments. The detailed description serves to explain the principles of the apparatus, systems, and methods. The apparatus, systems, and methods are susceptible to modifications and alternative forms. The application is not limited to the particular forms disclosed. The application covers all modifications, equivalents, and alternatives falling within the spirit and scope of the apparatus, systems, and methods as defined by the claims.

The market price for rare earth elements (the "critical rare earths") had risen appreciably several years ago, making the raw materials for phosphors expensive. The inventors have developed a phosphor that does not utilize "critical rare earths." The inventor's phosphor includes aluminum nitride in the form of a powder. In one embodiment the inventor's phosphor is deposited onto the surface of a fluorescent lamp envelope. In one embodiment the inventor's phosphor is phosphor doped to induce absorption at 254 nm and emission in at least a portion of the spectral region visible to the human eye. In one embodiment the inventor's phosphor is an orange-red emitting phosphor comprised of AlN doped with manganese ions. In one embodiment the inventor's phosphor is produced by heating AlN powder in pressurized nitrogen gas with a Mn source.

Referring now to the drawings and in particular to FIG. 1, one embodiment of the inventor's synthesis of the AlN:Mn phosphor is illustrated by a flow chart. The flow chart is designated generally by the reference numeral 100. The flow chart 100 of FIG. 1 includes the steps describe below.

Step 1 designated by the reference numeral 102: AlN powder—mixed with MnO

Step 2 designated by the reference numeral 104: heat to 1700° C. in flowing nitrogen Step 3 designated by the reference numeral 105: heat to 2000° C. in 10 atm nitrogen Step 4 designated by the reference numeral 106: AlN:Mn phosphor produced.

The inventors synthesized the embodiment 100 of a phosphor not incorporating "critical rare earths" producing an orange-red emitting phosphor comprised of AlN doped with manganese ions. The inventors made the phosphor 100 by heating AlN powder, under flowing nitrogen gas, with MnO, with $Mn(NO_3)_2$, with $MnCO_3$, and with Al:Mn alloy. High emission quantum yields were obtained in all cases. There are other ways in which the inventor's phosphor can be synthesized.

Figure 2:
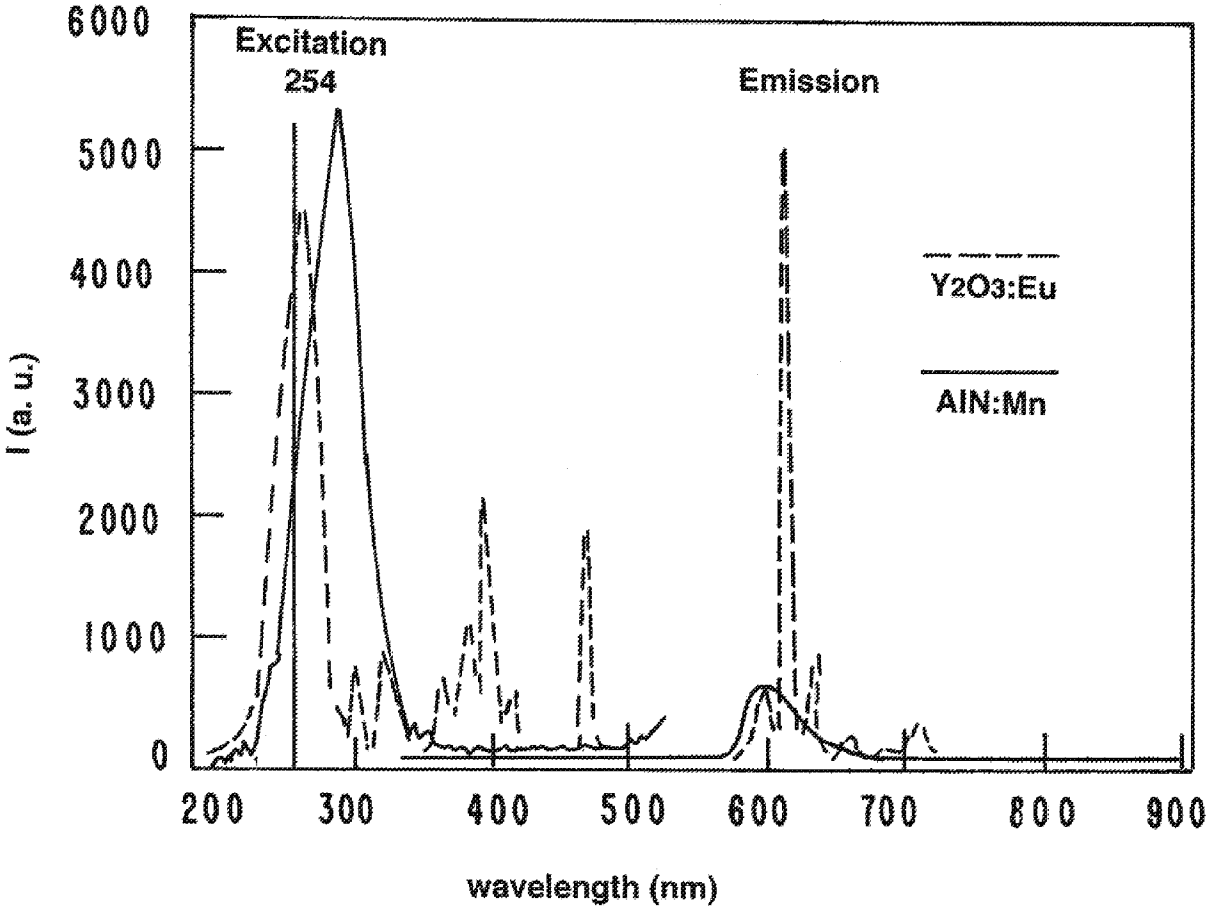
FIG. 2 is a graph illustrating characteristics of one embodiment of a phosphor of the subject application.

Referring now to FIG. 2, a graph illustrates the excitation and emission spectra of the inventor's phosphor. The inventors found that the AlN:Mn phosphor can be efficiently excited at 254 nm and the emission peak occurs near 600 nm. The calculated CIE coordinates of the AlN:Mn phosphor are X=0.60 and Y=0.37. The use of AlN:Mn will serve as alternative to the current use of europium-doped yttria (YEO), which has CIE coordinates of X=0.65 and Y=0.35.

The excitation and emission spectra for $Y_2O_3$:Eu (YEO) and AlN:Mn are shown in FIG. 2. The excitation spectrum reveals a similar absorption strength at the mercury line of 254 nm, as well as a comparable intensity of emission in the orange-red 570-650 nm range. The similarity of the properties will allow the inventor's AlN:Mn phosphor to be used as a "drop-in" replacement for YEO. The inventor's phosphor provides a good match in the emission efficiency, and lumen maintenance to the current YEO phosphor and means that the AlN:Mn will be a direct replacement.

Figure 3:
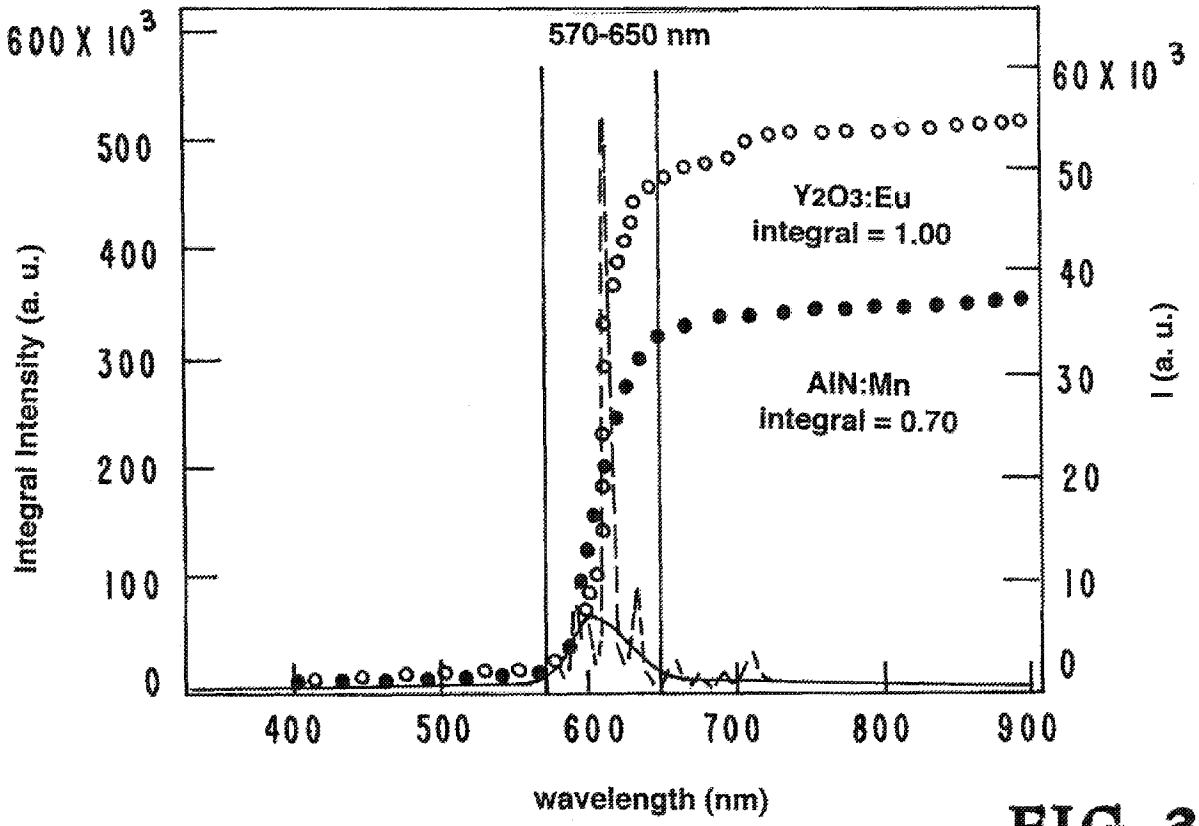
FIG. 3 is a graph illustrating characteristics of one embodiment of a phosphor of the subject application.

The integrated emission of the AlN:Mn phosphor in the 570-650 nm range is nearly identical to that of YEO, as shown in FIG. 3. The absolute intensity of the AlN:Mn phosphor compared to YEO measured with a given 254 nm excitation source is 70%. Additionally, the AlN:Mn phosphor exhibits much less absorption through the visible, compared to YEO, as is desired for proper functioning of the tri-phosphor blend.

Fluorescent lighting is currently a multi-billion dollar industry worldwide, as these types of lamps are used ubiquitously in indoor venues today. A fluorescent lamp or fluorescent tube is a low pressure mercury-vapor gas-discharge lamp that uses fluorescence to produce visible light. An electric current in the gas excites mercury vapor which produces short-wave ultraviolet light (principal wavelength of 254 nm) that then causes a phosphor coating on the inside of the bulb to fluoresce, producing visible light. A fluorescent lamp converts electrical energy into useful light much more efficiently than incandescent lamps. The luminous efficacy of a fluorescent light bulb can exceed 90 lumens per watt, several times the efficacy of an incandescent bulb with comparable light output.

The inventors have developed a new high quantum efficiency phosphor based on Aluminum Nitride that has been found to offer properties amenable to use in fluorescent lighting. Aluminum nitride powder has been found to activate with manganese, producing bright orange-red light, when excited with the 254 nm UV line from a mercury discharge, offering a spectrum and conversion efficiency comparable to commercial orange-red phosphors, but without use of any rare-earth elements.

Figure 4:
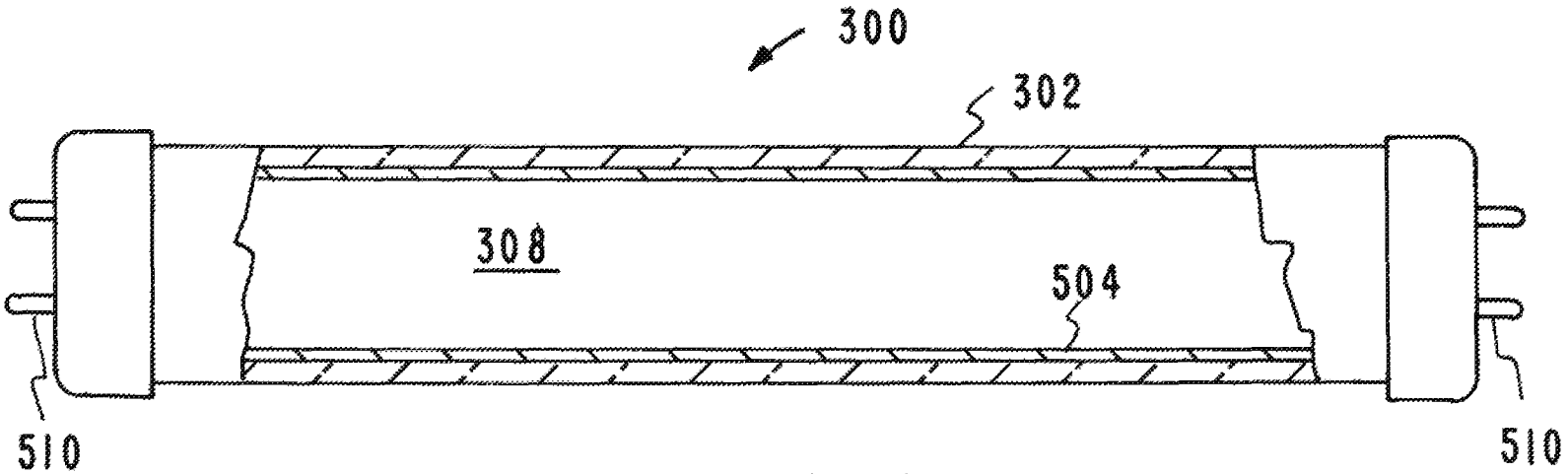
FIG. 4 is an illustration of one embodiment of a fluorescent lamp of the subject application.

Referring now to FIG. 4, one embodiment of the inventor's fluorescent lamp is illustrated. The embodiment of the inventor's fluorescent lamp is designated generally by the reference numeral 300. The fluorescent lamp 300 includes the following components: a glass envelope 302, Applicant's AlN:Mn phosphor coating 304 on the inside of the gas envelope 302, mercury and an inert gas 308 contained within the glass envelope 302, and electrodes 310.

AlN in general is known to be reactive to water, though means to passivate the surface are known. The inventors have found several means by which this has been accomplished, including heating to above 800° C. and by treating AlN in phosphoric acid (see for example, Materials Research Bulletin, Vol. 32, 1173-I 179 (1997), and Journal of the European Ceramic Society Vol. 15, 1079-1085 (1995). In these articles, the authors show that the rate of reactivity with water can be greatly diminished by creating a passivating layer on the surface of the particles. Without limiting the potential means of passivating the surface of the particles in the AlN powder, the methods of heating the particles in air or oxygen and treating the particles in phosphoric acid are noted as reported methods of creating a thin surface layer to reduce the reactivity of AlN to environmental conditions on the basis of published literature. As AlN is currently used for such applications as heatsinks and insulators for electronics and for optical windows, researchers have previously been developing methods for passivating the surfaces to help enable ceramic processing of AlN into highly compacted materials.

The fluorescent lamp 300 uses fluorescence from the inventor's AlN:Mn phosphor 304 to produce visible light. The electrodes 310 are used to direct an electric current into the inert gas 308 within the glass envelope 302 to excite mercury vapor which produces short-wave ultraviolet light that then causes the inventor's AlN:Mn phosphor 304 on the inside of the glass envelope 302 to fluoresce and produce visible light.

The disclosed apparatus provides a fluorescent lamp including a glass envelope; at least two electrodes connected to the glass envelope; mercury vapor and an inert gas within the glass envelope; and a phosphor blend within the glass envelope, wherein the phosphor blend includes $Al_{(1-x)}M_xN$, where M may be comprised of one or more dopants drawn from beryllium, magnesium, calcium, strontium, barium, zinc, scandium, yttrium, lanthanum, cerium, praseodymium, europium, gadolinium, terbium, ytterbium, bismuth, manganese, silicon, germanium, tin, boron, or gallium and x has a value of $0<x<0.1$. In one embodiment the $Al_{(1-x)}M_xN$ is doped with at least M=manganese; wherein x has the value of $0<x<0.1$. In one embodiment the $Al_{(1-x)}M_xN$ contains between about 0.001% and 10% manganese. In one embodiment the $Al_{(1-x)}M_xN$ is in the form of a powder with grains in the 0.1-50 micron range. In one embodiment the powder is deposited onto the surface of the lamp envelope. In one embodiment the $Al_{(1-x)}M_xN$ phosphor is doped with carbon and/or oxygen, together with manganese by processing conditions or addition of dopants to induce an absorption at 254 nm and emission in at least a portion of the spectral region visible to the human eye. In one embodiment the fluorescent lamp emission is in the orange-red, most preferably near 570-650 nm. In one embodiment the emission has a quantum efficiency of at least 50% with respect to absorbed photons at 254 nm. In one embodiment the phosphor is doped by using a starting material selected from a manganese oxide, a manganese halide, manganese carbonate, manganese nitrate, a manganese-containing salt, manganese nitride, manganese metal, an organo-manganese compound or a manganese-containing aluminum alloy. In one embodiment the doping is incorporated in a reducing atmosphere or an oxygen-free atmosphere. In one embodiment the phosphor is processed to reduce the surface's sensitivity to water in a fluorescent lamp. In one embodiment the phosphor is processed by heating in an atmosphere of more than 90% nitrogen. In one embodiment the phosphor is processed by heating in an atmosphere wherein gas pressure is more than 1 atmosphere. In one embodiment the phosphor is processed at temperature of at least 1500° C. In one embodiment the phosphor is processed at temperature above 1700° C. In one embodiment the surface of the phosphor is post-processed in a reactive solution or vapor. In one embodiment the surface of the phosphor is processed in an acidic solution, most preferably phosphoric acid. In one embodiment the phosphor has a CIE coordinate of about X=0.60±0.05 and Y=0.37±0.05. In one embodiment the phosphor blend is combined with at least one additional phosphor to create another color of light.

The disclosed method of making a fluorescent lamp includes the steps of heating $Al_{(1-x)}M_xN$ powder under flowing nitrogen gas, adding a source of Mn, thereby producing $Al_{(1-x)}M_xN$:Mn phosphor; providing a glass envelope; providing mercury vapor, an inert gas, and the $Al_{(1-x)}M_xN$:Mn phosphor within the glass envelope, and providing at least two electrodes connected to the glass envelope to produce the fluorescent lamp. In one embodiment the $Al_{(1-x)}M_xN$ is doped with manganese. In one embodiment the powder is deposited onto the surface of the glass envelope. In one embodiment the phosphor is post-processed by heating in air or oxygen at a temperature above room temperature, preferably above 500° C. In one embodiment the phosphor is combined with at least one additional phosphor to create another color of light.

Although the description above contains many details and specifics, these should not be construed as limiting the scope of the application but as merely providing illustrations of some of the presently preferred embodiments of the apparatus, systems, and methods. Other implementations, enhancements and variations can be made based on what is described and illustrated in this patent document. The features of the embodiments described herein may be combined in all possible combinations of methods, apparatus, modules, systems, and computer program products. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments.

Therefore, it will be appreciated that the scope of the present application fully encompasses other embodiments which may become obvious to those skilled in the art. In the claims, reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present apparatus, systems, and methods, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

While the apparatus, systems, and methods may be susceptible to various modifications and alternative forms, specific embodiments have been shown by way of example in the drawings and have been described in detail herein. However, it should be understood that the application is not intended to be limited to the particular forms disclosed. Rather, the application is to cover all modifications, equivalents, and alternatives falling within the spirit and scope of the application as defined by the following appended claims.

The claims are:

1. A fluorescent lamp, comprising:

a glass envelope;

at least two electrodes connected to said glass envelope;

mercury vapor and an inert gas within said glass envelope; and a phosphor blend within said glass envelope, wherein said phosphor blend includes $Al_{(1-x)}M_xN$, where M may be comprised of one or more dopants drawn from beryllium, magnesium, calcium, strontium, barium, zinc, scandium, yttrium, lanthanum, cerium, praseodymium, europium, gadolinium, terbium, ytterbium, bismuth, manganese, silicon, germanium, tin, boron, or gallium and x has a value of $0<x<0.1$.

2. The fluorescent lamp of claim 1 wherein said $Al_{(1-x)}M_xN$ is doped with at least M=manganese; wherein x has the value of $0<x<0.1$.

3. The fluorescent lamp of claim 1 wherein said $Al_{(1-x)}M_xN$ contains between about 0.001% and 10% manganese.

4. The fluorescent lamp of claim 1 wherein said $Al_{(1-x)}M_xN$ is in the form of a powder with grains in the 0.1-50 micron range.

5. The fluorescent lamp of claim 4 wherein said powder is deposited onto the surface of the lamp envelope.

6. The fluorescent lamp of claim 1 wherein said $Al_{(1-x)}M_xN$ phosphor is doped with carbon and/or oxygen, together with manganese by processing conditions or addition of dopants to induce an absorption at 254 nm and emission in at least a portion of the spectral region visible to the human eye.

7. The fluorescent lamp of claim 6 wherein said emission is in the orange-red, most preferably near 570-650 nm.

8. The fluorescent lamp of claim 6 wherein said emission has a quantum efficiency of at least 50% with respect to absorbed photons at 254 nm.

9. The fluorescent lamp of claim 1 wherein said phosphor is doped by using a starting material selected from a manganese oxide, a manganese halide, manganese carbonate, manganese nitrate, a manganese-containing salt, manganese nitride, manganese metal, an organo-manganese compound or a manganese-containing aluminum alloy.

10. The fluorescent lamp of claim 1 wherein said doping is incorporated in a reducing atmosphere or an oxygen-free atmosphere.

11. The fluorescent lamp of claim 1 wherein said phosphor is processed to reduce the surface's sensitivity to water in a fluorescent lamp.

12. The fluorescent lamp of claim 1 wherein said phosphor is processed by heating in an atmosphere of more than 90% nitrogen.

13. The fluorescent lamp of claim 1 wherein said phosphor is processed by heating in an atmosphere wherein gas pressure is more than 1 atmosphere.

14. The fluorescent lamp of claim 1 wherein said phosphor is processed at temperature of at least 1500° C.

15. The fluorescent lamp of claim 1 wherein said phosphor is processed at temperature above 1700° C.

16. The fluorescent lamp of claim 1 wherein said surface of said phosphor is post-processed in a reactive solution or vapor.

17. The fluorescent lamp of claim 1 wherein said surface of said phosphor is processed in an acidic solution, most preferably phosphoric acid.

18. The fluorescent lamp of claim 1, wherein said phosphor has a CIE coordinate of about X=0.60±0.05 and Y=0.37±0.05.

19. The fluorescent lamp of claim 1 wherein said phosphor blend is combined with at least one additional phosphor to create another color of light.

20. The fluorescent lamp of claim 1 wherein said phosphor blend does not include rare earths.

21. A method of making a fluorescent lamp, comprising the steps of:

heating $Al_{(1-x)}M_xN$ powder under flowing nitrogen gas;

adding a source of Mn, thereby producing an $Al_{(1-x)}M_xN$:Mn phosphor;

providing a glass envelope;

providing mercury vapor, an inert gas, and said $Al_{(1-x)}M_xN$:Mn phosphor within said glass envelope, and providing at least two electrodes connected to said glass envelope to produce the fluorescent lamp.

22. The method of making a fluorescent lamp of claim 21 wherein said $Al_{(1-x)}M_xN$ is doped with manganese.

23. The method of making a fluorescent lamp of claim 21 wherein said wherein said powder is deposited onto the surface of the glass envelope.

24. The method of making a fluorescent lamp of claim 21 wherein said phosphor is post-processed by heating in air or oxygen at a temperature above room temperature, preferably above 500° C.

25. The method of making a fluorescent lamp of claim 21 wherein said phosphor is combined with at least one additional phosphor to create another color of light.

26. The method of making a fluorescent lamp of claim 21 wherein the fluorescent lamp does not include rare earths.

* * * * *